US006652804B1

(12) United States Patent
Neumann et al.

(10) Patent No.: US 6,652,804 B1
(45) Date of Patent: Nov. 25, 2003

(54) METHOD FOR PRODUCING AN OPENLY POROUS SINTERED METAL FILM

(75) Inventors: Peter Neumann, Remscheid (DE); Andreas Kuhstoss, Remscheid (DE)

(73) Assignee: GKN Sinter Metals GmbH (DE)

( * ) Notice: Subject to any disclaimer, the term of this patent is extended or adjusted under 35 U.S.C. 154(b) by 0 days.

(21) Appl. No.: 09/647,790

(22) PCT Filed: Apr. 17, 1998

(86) PCT No.: PCT/EP98/02254

§ 371 (c)(1),
(2), (4) Date: Oct. 5, 2000

(87) PCT Pub. No.: WO99/54524

PCT Pub. Date: Oct. 28, 1999

(51) Int. Cl.[7] ..... B22F 3/10; B22F 7/04
(52) U.S. Cl. ..... 419/2; 419/7; 419/9
(58) Field of Search ..... 419/2, 7, 9

(56) References Cited

U.S. PATENT DOCUMENTS

| | | | | | |
|---|---|---|---|---|---|
| 2,267,918 | A | * | 12/1941 | Hildabolt | 29/189 |
| 3,855,638 | A | | 12/1974 | Pilliar | 3/1 |
| 4,208,472 | A | * | 6/1980 | Cho et al. | 428/550 |
| 4,356,215 | A | * | 10/1982 | Auriol et al. | 427/244 |
| 4,608,225 | A | * | 8/1986 | Sakuramoto et al. | 419/5 |
| 4,629,483 | A | * | 12/1986 | Stanton | 55/487 |
| 4,746,341 | A | * | 5/1988 | Komoda | 55/487 |
| 4,793,968 | A | * | 12/1988 | Mosser et al. | 428/550 |
| 4,888,114 | A | * | 12/1989 | Gaddis et al. | 210/500.25 |
| 4,923,761 | A | * | 5/1990 | Shindo | 428/550 |
| 5,132,080 | A | * | 7/1992 | Pfeil | 419/2 |
| 5,592,686 | A | | 1/1997 | Third et al. | 419/2 |
| 5,925,156 | A | * | 7/1999 | Motoki et al. | 55/487 |
| 6,042,778 | A | * | 3/2000 | Kraft et al. | 419/27 |

FOREIGN PATENT DOCUMENTS

| | | |
|---|---|---|
| DE | 2 323 878 | 11/1974 |
| EP | 0 436 834 A2 | 7/1991 |
| EP | 0 525 325 B1 | 2/1993 |
| FR | 2 520 265 | 1/1983 |
| JP | 57 88967 | 3/1982 |
| JP | 908157910 A | 6/1996 |
| WO | WO 94/19510 | 9/1994 |

* cited by examiner

*Primary Examiner*—Daniel J. Jenkins
(74) *Attorney, Agent, or Firm*—Woodcock Washburn LLP

(57) ABSTRACT

A method for producing a thin openly porous metal film from a metal powder that can be sintered. The metal powder is suspended in a carrier fluid with a specific size distribution of particles, the suspension is applied to a supporting material in at least one thin film and dried, and the green layer thus formed is sintered. The thickness of the layer formed by suspension thus applied corresponds at least to the thickness (s) of the metal film to be produced after sintering, whereby (s) is at least three times the value of the diameter (D) of the powder particles, D=1–50 urn and the maximum thickness of the finished metal film is 500 $\mu$m.

20 Claims, 3 Drawing Sheets

METHOD FOR PRODUCING AN OPENLY POROUS SINTERED METAL FILM

DESCRIPTION

Figure 1:
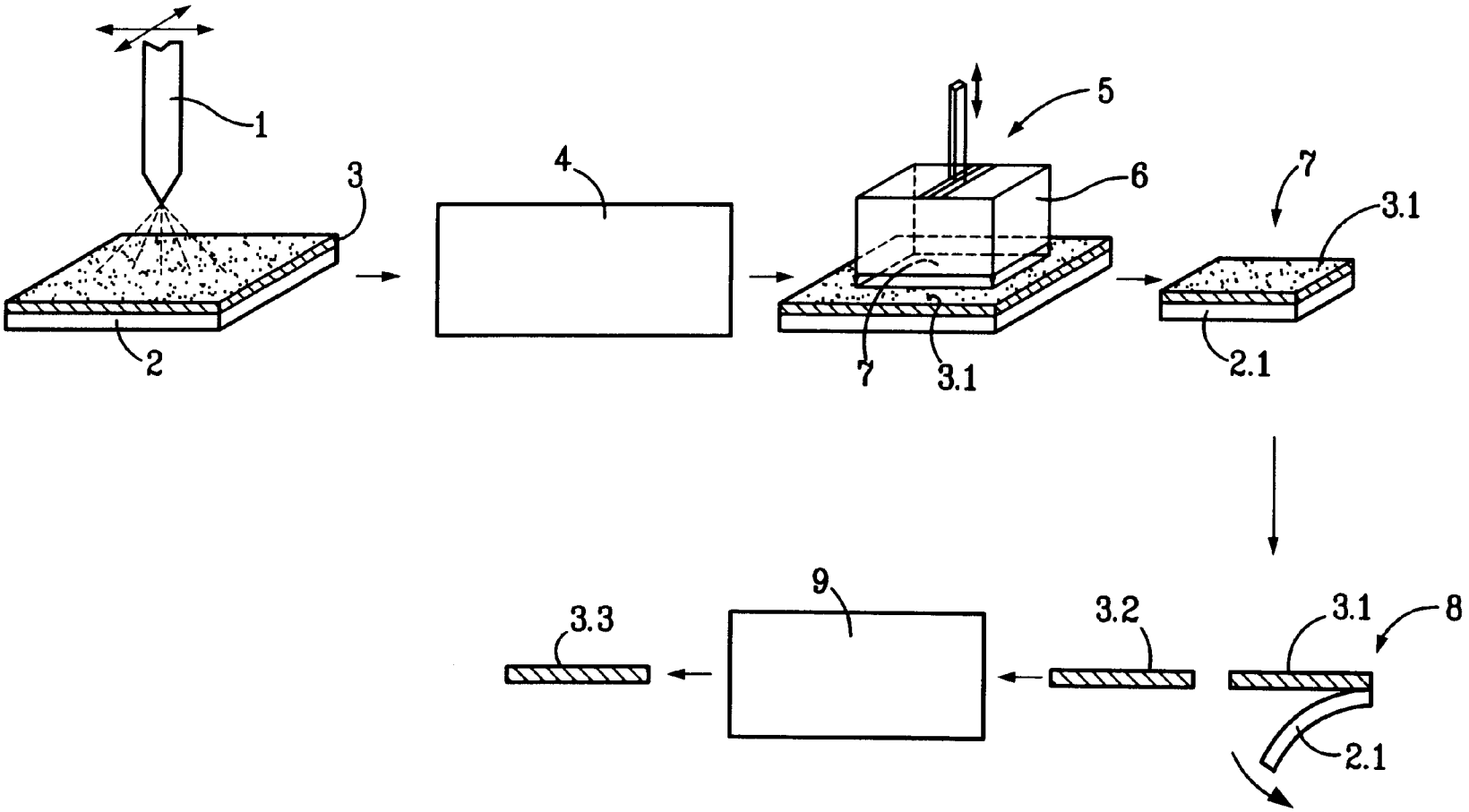

The invention involves a process for manufacturing an openly porous sintered metal film from a metal powder that can be sintered.

In engineering, porous structures, which have a flowing medium flowing through them, are needed for very diverse applications, where either reactive processes are to be supported or solid particles contained in the flowing medium are held back, i.e. filtered out. Filter bodies made of ceramic materials, because of the danger of breaking, must be constructed so that they are relatively thick. Also, filter bodies made of pressed and sintered metal powders are relatively thick for reasons of manufacturing engineering. On account of the thickness that is not to be reduced, correspondingly large flow resistances occur, especially for fine-porous material. The use of plastics as a filter material has limits due to the low solidity and low resistance to temperature. A use of metallic materials as a porous layer is known in the form of fabrics or nonwoven (fleece) fabrics made from metal fibers.

In a porous layer of this type, which has a medium flowing through it, there is the need to minimize undesired flow resistances, so that as thin a layer thickness as possible is desired. From a metal fabric or nonwoven (fleece) fabric, suitably thin layers, for example, in a thickness of approximately 100 $\mu$m, can certainly be manufactured. They are, however, less dimensionally stable, have relatively large pores and in regards to their porosity, have large tolerances. Since in order to manufacture fabrics and fleeces of this type, correspondingly thin and thus also expensive wires must be used, the fabric and fleece made in this way are correspondingly expensive.

From EP-B-0 525 325, a process for manufacturing porous, metallic sintered workpieces is known in which at first, a metallic powder is suspended in a carrier fluid, which consists of a binder dissolved in a solvent and which is adjusted so that the suspension is able to be cast. This suspension is poured into a mold. Then, the solvent is evaporated, so that the metal powder becomes solidified, by the remaining binder, in the geometry given by the mold and forms a green body that can be handled. After separating from the mold, the green body is sintered in the usual manner. This previously known process is provided preferably for the manufacture of relatively thick-walled sintered parts, which can be manufactured because of their geometry better through a molding operation than in the traditional process through pressing a metal powder into a mold. Thin-layered, open, porous parts can not be manufactured with this process.

The purpose of the invention is to improve the previously known process, so that even thin, porous and to the extent necessary, even self-supporting metal films can be manufactured.

This purpose is achieved according to the process according to the invention in that the metal powder is suspended at a prespecified size distribution of powder particles in a carrier fluid, that the suspension is applied in at least a thin layer to a carrier structure, dried, and the green layer formed in this way is sintered, so that the layer thickness of the suspension applied corresponds after sintering at least to the thickness s of the metal film to be created, where s corresponds to at least 3 times the diameter D of the power particles, with D=1 $\mu$m to 50 $\mu$m, where the layer thickness of the finished metal film is at maximum 500 $\mu$m. In this process, the advantage is utilized that during sintering the individual powder particles do indeed connect solidly to each other, however, between the powder particles, open spaces remain, which produce an open porosity relative to the thickness of the metal film, so that the metal film is permeable for a medium flowing through it. The amount of the porosity can be influenced via the particle size of the metal powder used, so that very thin porous metal films with a prespecified pore size can be manufactured. Since non-homogeneities and hollow cavities can occur during manufacturing, the layer thickness must correspond to at least 3-times the diameter D of the powder particles. By the named ratio between the layer thickness s and the particle diameter D it is ensured that several "layers" of powder particles are always arranged over each other and "holes" that go through, which are larger than the desired porosity, are prevented. In this process, it is especially functional if the layer thickness s is 5 to 15 times, preferably 10 to 15 times the diameter D of the powder particles. "Holes that go through" can be avoided by this.

Diameter D is understood to be the average particle diameter of the metal powder used. Metal powders in the context of the invention are not only powders made of pure metal, but also powders made of metal alloys and/or powder mixtures of different metals and metal alloys. Belonging to them are especially steels, preferably chromium-nickel-steels, bronzes, nickel master alloys such as Hastalloy, Inconel or the like, where powder mixtures also contain refractory components such as, for example, platinum or the like. The metal powder to be used and its particle size depend on the respective application.

The consistency of the suspension to be set via the carrier fluid is essentially oriented according to how the suspension is applied to the carrier structure. For casting, if necessary, with subsequent strickling of an excess from the cast suspension layer, the suspension can be adjusted in a somewhat viscous consistency. In a so-called film molding or a spraying on, a low-viscosity consistency must be specified. In order be able to handle the carrier structure with the applied green layer after drying, it is also functional here that the carrier liquid is formed through a binder that is liquefied by a solvent that can be vaporized. In this way, it is ensured that the green layer also has a sufficient solidity as a result of the bonding of the individual powder particles to each other via the binder.

In an especially preferred embodiment form it is provided that the suspension is applied onto the carrier structure in several thin partial layers in sequence. In this process, the individual carrier layers can each be constructed out of an identical suspension. It is also possible, however, in a subsequent embodiment of the invention, for the individual partial layers to each use suspensions with varying size distributions for the metal powder that is used and/or to use different metal powders. This makes it possible, for example, to use metal powders on the one hand, which give an especially good porosity to the completed sintered metal film, and on the other hand, it is also possible to manufacture at least one metal film, which has in its metal composition especially favorable properties for the application purpose, for example, catalytic properties.

It is functional when the respectively applied partial layer is dried on at least prior to the application of the next partial layer. In this way, it is ensured that the first applied partial layer is sufficiently affixed so that it is not deformed by the application process, for example, by a spraying on of the next partial layer. On the other hand, by the remaining solvent portion in the previously applied, dried-on partial layer, it is ensured that also the next partial layer that follows is bonded reliably and with the same packing density and the finished green layer has the desired solidity.

In another embodiment of the invention it is provided that the respective partial layer is sintered prior to the application of the next partial layer. This process is especially advantageous when in a multiple layer construction, different metal powders are applied, which require greatly differing sinter temperatures. In this way, it is possible that at first the partial layer is applied onto the carrier structure, which contains the metal powder with the highest sintering temperature, and after sintering the first metal film, the next following partial layers with the respectively lower sintering temperatures can be applied and sintered in the corresponding sequence. This has the advantage that by the individual sintering steps, the desired porosity of the individual partial layers is maintained, which would be lost if the suspension with a heterogeneous powder mixture of this type were to be applied in one layer and sintered in one step. In the process, because of the necessary high sintering temperatures for only a portion in the powder mixture, the remaining, low-sintering powder portions would dense-sinter, so the porosity would be lost for the most part.

In a preferred embodiment of the invention, it is provided that the suspension is applied as a layer on a flat, flexible carrier structure, and after drying is separated as a green layer from the carrier structure and sintered separately into a membrane-like, porous finished part. The advantage of this process consists in that at first a relatively large area green layer can be manufactured, from which after drying, by punching or cutting, partial pieces of film and green layer can be made in the desired shape. In these partial pieces, the green layer is pulled off of the carrier structure and then sintered as an independent part. As the carrier, plastic or metal film can be used in the process. The carrier structure is functionally coated with a separating agent prior to applying the suspension.

In an especially advantageous other embodiment of the invention, it is provided that the suspension is applied as a layer onto a high temperature-resistant, preferably flat carrier structure, dried on it, sintered and then removed from the carrier structure as a membrane-like, porous, metallic finished piece. As the carrier structure, a material is used, which during sintering does not enter into a bond with the green layer located on the carrier structure, as is the case for example in ceramic materials. This process offers the possibility for manufacturing membrane-like, metallic, porous finished parts industrially with a small portion of manual work using automation to a large extent. The special advantage in the process lies in that the dried, still sensitive green layer for performing the sintering process does not have to be removed from the carrier structure and handled in the process, but instead, that it is first removed after sintering. In this way, the waste is reduced and furthermore, there is the possibility for providing a smaller binder portion for the carrier liquid in order to create the suspension, since only as much binder is to be added to ensure a secure handling of the carrier structure after spraying on the layer until putting it into the sintering oven.

Also in this process, the suspension can be applied by pouring or spraying onto the carrier structure. In order to prevent a cutting or punching of the green layer with the carrier structure or of the finished porous metal membrane, it is functional when in the embodiment of the invention prior to the application of the suspension to the carrier structure, a contour mask is applied. In this way it is possible to apply the suspension onto the support readily in the end contour provided, so that a subsequent cutting operation is not necessary. An additional advantage of the use of a contour mask consists in that the suspension applied especially by a spraying operation also has the prespecified layer thickness in the edge area defined by the contour mask. There is even the possibility to give to the finished porous membrane a somewhat larger thickness in the edge area by a corresponding additional spraying run in which in an overflow, only the edge area is sprayed with suspension, so that a better shape rigidity is present here and a sufficient deformation volume is present, if for example a porous membrane of this type should be braced on the edge.

In the application of the previously explained process according to the invention for manufacturing sintered metal films of this type in the form of a thin, porous membrane, which can be used in place of fabrics or fleeces, it has been surprisingly revealed that the finished, sintered membrane is ductile, mechanically stable and elastic within certain limits so that a membrane of this type can be manufactured with a porosity defined with narrow tolerances and small flow resistance, such that the porosity is determined essentially through the specification of the particle size and the flow resistance is determined through the thickness and the particle size of the sintered metal film. By the selection of the metal to be applied, metal alloys and/or the metal powder mixtures for the metal powder, practically every requirement in regard to mechanical, thermal and/or chemical resistance can be met.

In an advantageous additional embodiment of the process according to the invention, it is further provided that the finished sintered porous membrane is calibrated by rolling. Through this measure, a defined thickness can be set and the surface smoothed. Furthermore, the pore size in the metal film can be reduced in a defined manner, since for the low thickness, not only the surface areas, but also the metal film as a whole is "deformed through". In this way, however, the possibility is also allowed for the membrane to first be manufactured with a somewhat larger thickness and to be manufactured with a somewhat coarser and thus more cost-effective metal powder, and after that, to reduce the pore size reproducibly through the rolling operation. Provided the carrier structure is simultaneously also a component of the finished part and accordingly the metal film should be affixed to it, it is provided in another embodiment that the suspension is applied to at least one surface of a metallic carrier structure, dried and the green layer is then sintered solid on the carrier structure. The carrier structure can in this process for its part be a sintered shaped part, even a porous sintered shaped part with a coarse porous structure. The suspension can in turn be applied through thin-film casting, spraying or immersing onto the surface of the carrier structure. The metal film can depending on the application, be applied to the outer wall and/or the inner wall.

If the metallic carrier structure is formed through a tube-shaped carrier structure, then in the embodiment of the process according to the invention, it is provided that during the application of the suspension and at least during a part of the drying time, the carrier structure is rotated around the tube axis. In this way, it is ensured that the layer thickness is maintained until the suspension is affixed as a green layer onto the carrier structure. In this process it is functional, especially for thin-film casting and during spraying, if the suspension outlet is additionally moved for rotation relative to the surface.

Porous membranes manufactured as a finished part or porous metal films applied on a porous carrier structure are especially suitable for use as filters and upon corresponding adjustment of the porosity of the metal film also as micro-filters. In impermeable carrier structures, a structural part of this type can also be used as a catalyst when the composition is suitable in terms of the metal powder used and when the porosity is suitable.

Figure 2:
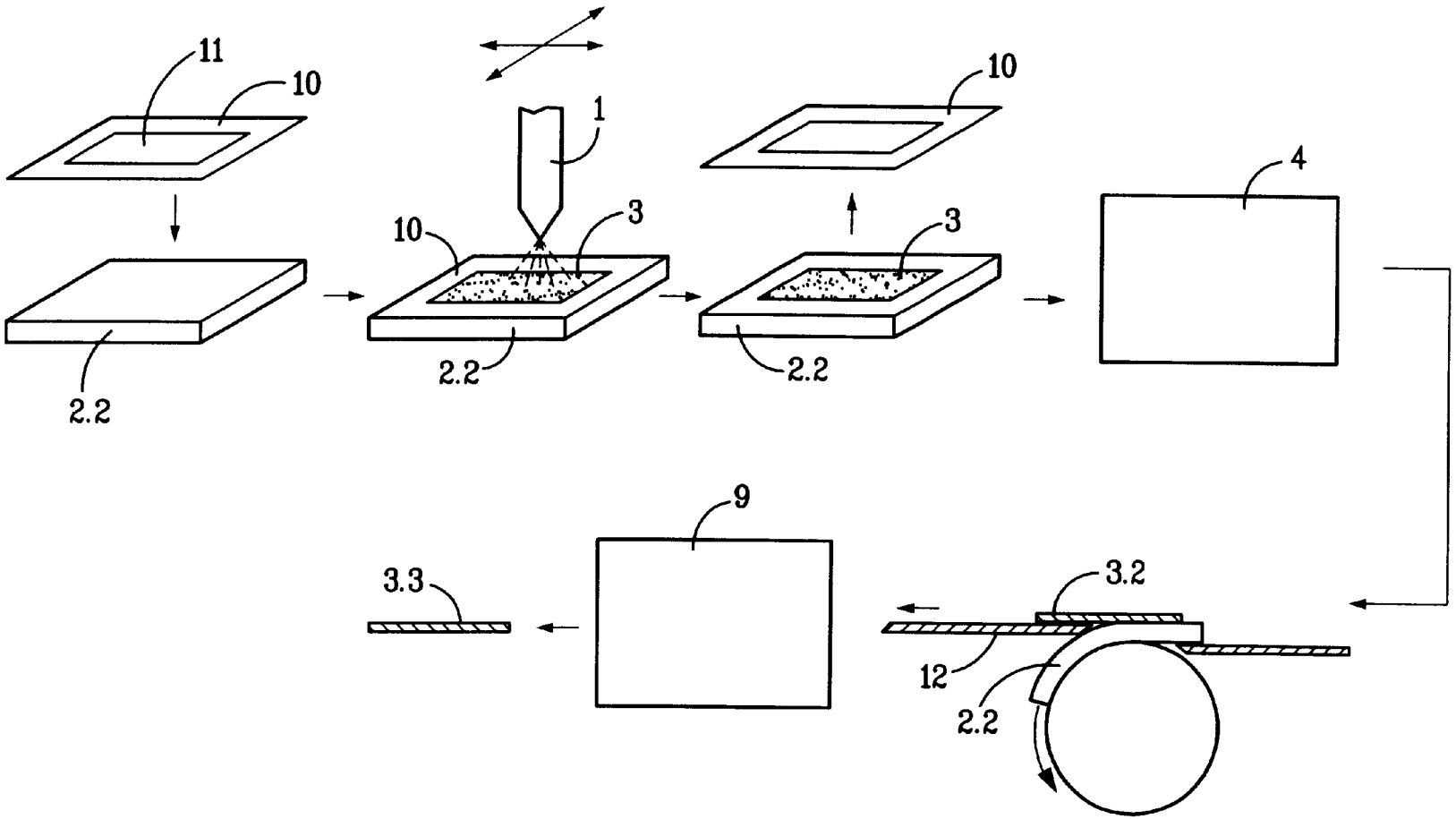
Figure 3:
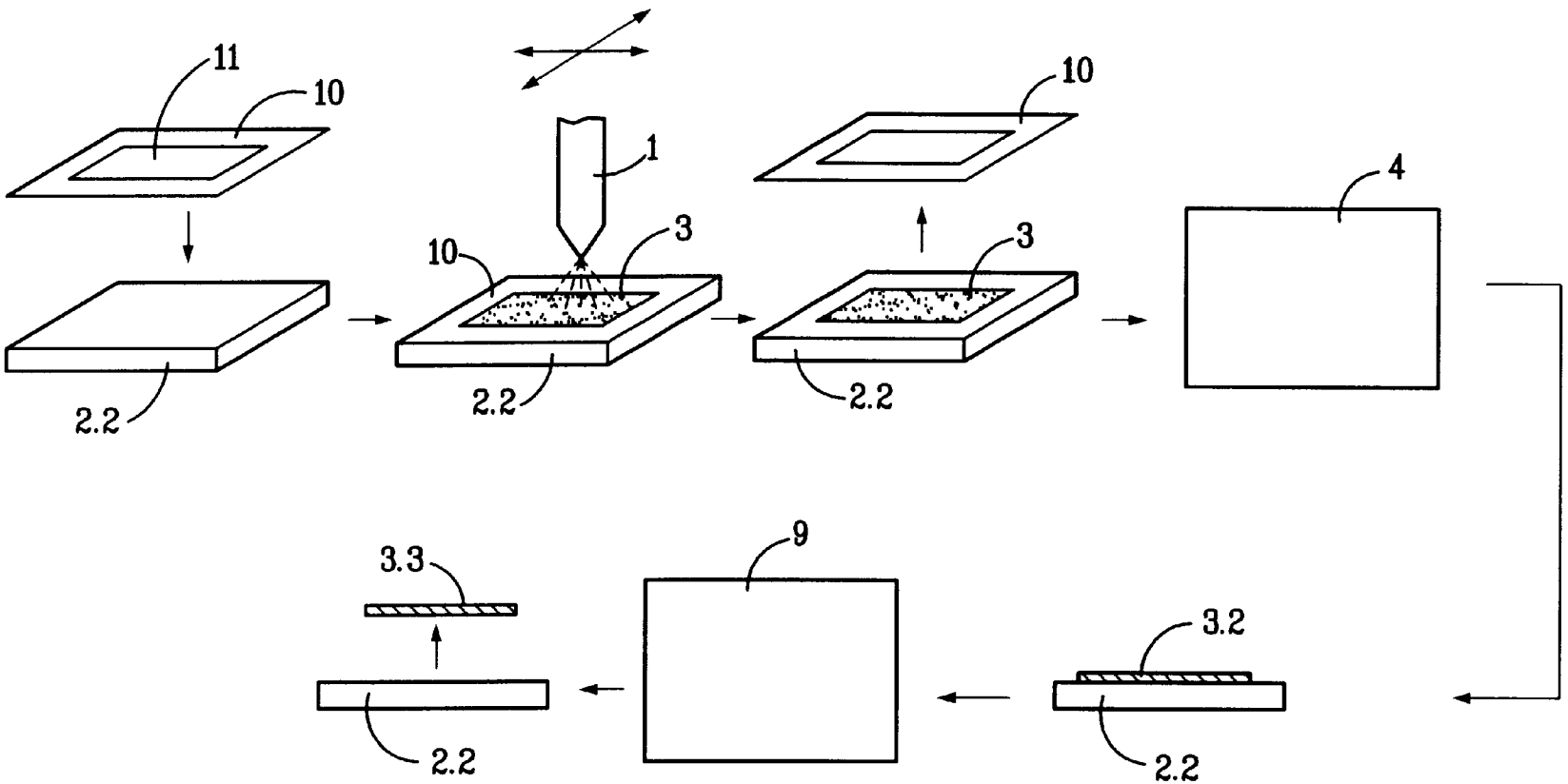

In the following, the process according to the invention is explained in greater detail using schematic flow diagrams, for the application case of the manufacturing of thin, porous metal films, which are used as an independent part. Shown are:

FIG. 1 a process flow, in which the part is formed by a punching step,

FIG. 2 a process flow, in which the part is formed by a spray operation and sintered independently, FIG. 3 a process flow, in which the part is formed by a spray operation and sintered with the help of a carrier structure.

In the process depicted in FIG. 1, a suspension formed from a metal powder that can be sintered and a carrier fluid is applied as a thin film 3 with the aid of a spray or cast head 1 onto a carrier structure 2 in the form of a larger film section made of a plastic film or metal film. The carrier structure 2 coated with a thin suspension layer 3 is conducted in the process through a larger film section and then guided into a drying device 4, in which under the action of heat, the carrier fluid, for example, ethanol or isopropanol, is vaporized. A binder that is dissolved approximately in the carrier liquid remains in the thin film to increase the green strength.

The film section that is dried in this way and from now on is provided with a solid green film 3.1, is then supplied to a punching device 5, in which with the help of a punching tool 6, a part 7 is punched out in the desired outer contour together with the film part that is adhering as a carrier structure 2. In order to simplify, only the punching out of a part 7 is depicted here. There is the possibility in the process, however, in one punching step or punching steps that follow each other, to punch out several parts 7 from the film section provided with the green layer.

In a subsequent separation step 8, the part 2.1 of the carrier film, which is punched out also, is pulled off of the green layer 3.1, which is then brought in as a green compact 3.2 into a sintering oven 9, and there sintered under the conditions to be specified for the respective powder composition. The finished part 3.3 can then be taken out of the sintering oven 9 in the form of a solid, thin metal film with open porosity.

In the process according to FIG. 2, a mask 10 is placed on a flexible, but also dimensionally stable carrier structure 2.2, for example, made out of a silicone rubber. The mask 10 is provided with a section 11, which corresponds to the desired end contour of the porous metal film part to be manufactured. Then, as described using FIG. 1—the carrier structure 2.2 provided with a corresponding mask is sprayed with a metal suspension using a spraying or casting head 1, so that a corresponding thin suspension layer 3 is applied on the carrier structure 2.2 in the area defined by the section 11 of the mask 10. Also here, the mask 10 can be provided with many corresponding sections 11 for a corresponding surface size of the carrier structure 2.2.

In a next step, the mask 10 is removed, so that the carrier structure 2.2 with the thin suspension layer 3 remaining on it can be introduced into the drying oven 4, in which the carrier fluid is vaporized.

In a subsequent separation step 8, the green layer 3 is removed from the carrier structure 2.2, which is indicated here schematically through a bending of the carrier structure 2.2 on the edge of a cut 12, so that then the isolated green compact is in turn sintered in the sintering oven 9. From the sintering oven 9, the finished part 3.3 can then be taken out in the form of a solid, thin openly porous metal film. In this procedural method, the punching step 5 is omitted, since by the mask 10 with its section 11, the required contour is already present. The carrier structure is kept and can be used further.

The process depicted schematically in FIG. 3 corresponds in its flow up to the process step of the drying in the drying oven 4 to the process described using FIG. 2, so that reference is made to the previous description. The difference consists in the process merely in that the carrier structure 2.2 is made out of a high-temperature-resistant material, which does not enter during sintering into any connection with the green layer 3 located on the carrier structure, as is the case, for example, with a ceramic material.

In contrast to the process according to FIG. 2, the carrier structure 2.2 is introduced with the green compact 3.2 located above it into the sintering oven 9 and is also removed from the sintering oven 9 together with the carrier structure 2.2. Only the finished, sintered porous metal film part 3.3 is then removed from the carrier structure 2.2.

In all processes it is possible through several spraying or casting overflows with differently structured suspensions, to create a multiple layer construction for the metal film part to be manufactured.

The process described using FIG. 3 offers, in addition, the advantage that at first only one layer is applied to the temperature-resistant carrier structure 2.2 and final-sintered onto the carrier structure. In addition, onto the final-sintered porous metal film still located on the carrier structure 2.2, an additional layer made of a suspension that is possibly composed in another way is applied, which then—as described above—is dried and sintered. Through the sintering operation, a solid bond results between the first and the second as well as every other metal film applied in this way. The advantage of this consists in that the second and also every other metal film yet to be applied can be sintered in regard to their different composition as well as under different temperature conditions. Thus, it is possible, for example, to sinter a metal powder composition in a first step at a high sintering temperature as a porous layer and then to sinter onto that, metal powder compositions in the second and every other layer as a porous layer, which because of their compositions must be sintered each time at lower temperatures. In this way, it is ensured that by respectively adapted sintering conditions, the desired porosity of the individual layers are maintained.

By the contour masks used in the process according to FIGS. 2 and 3, the possibility is also provided to perform during an application of the suspensions in the spraying process, each time after the formation of the main layer, additional overflows in the edge area, so that a porous metal film part can be manufactured with a reinforced edge.

What is claimed is:

1. A process for manufacturing an openly porous, thin metal film from a sinterable metal powder comprising pure powder of a single metal, a mixture of pure powders of two or more metals, powders of metal alloys, or mixtures of said alloy powders with one or more pure metal powders, said sinterable metal powder having an average powder particle size of 1–50 microns, the process comprising the steps of:

(a) suspending the powder in a carrier fluid comprising a binder and a solvent;

(b) applying the suspension to a carrier substrate to form a metal layer having a thickness at least three times the diameter of the powder particles and a maximum thickness of 500 microns;

(c) drying the metal layer to form a green layer;

(d) sintering the green layer to form a metal film having a thickness corresponding to the thickness of the metal layer applied in step (b).

2. The process of claim 1 wherein the applying step (b) comprises adding two or more partial layers of suspension onto the carrier substrate to form said metal layer.

3. The process of claim 2 wherein said adding step includes application of at least two partial layers, and wherein the suspended powders used to apply at least one partial layer have a different particle size distribution than the suspended particles used to apply at least one other partial layer.

4. The process of claim 2 or 3 wherein said adding step includes application of at least two partial layers, and wherein the suspended powders used to apply at least one partial layer comprise a metal powder different from the metal powder used to apply at least one other partial layer.

5. The process of claim 2 or 3 wherein a first partial layer of the adding step is dried to form a green partial layer prior to application of a subsequent partial layer.

6. The process of claim 4 wherein a first partial layer of the adding step is dried to form a green partial layer prior to application of a subsequent partial layer.

7. The process of claim 5 wherein the first partial layer of said adding step is sintered prior to application of a subsequent partial layer.

8. The process of claim 6 wherein the first partial layer of said adding step is sintered prior to application of a subsequent partial layer.

9. The process of claim 1 wherein a contour mask is disposed on the carrier substrate prior to said applying step (b).

10. The process of claim 1 wherein the suspension in said applying step (b) is applied to the carrier substrate through thin film casting, spraying, or immersion.

11. The process of claim 1 wherein the suspension in said applying step (b) is applied to the carrier substrate through a head that is moved relative to the carrier substrate.

12. The process of claim 1 wherein said green layer is separated from the carrier substrate prior to said sintering step (d).

13. The process of claim 1 wherein said metal film is separated from the carrier substrate after said sintering step (d).

14. The process of claim 1 wherein said carrier substrate is tubular.

15. The process of claim 14 wherein the tubular carrier substrate has a central axis and is rotated about said central axis during said applying step (b) and during at least a portion of said drying step (c).

16. The process of claim 1 further comprising the step of calibrating said metal film by rolling.

17. The process of claim 12 wherein the substrate is flat and flexible.

18. The process of claim 13 wherein the substrate is resistant to high temperature.

19. The process of claim 13 or 18 wherein the substrate is flat.

20. The process of claim 12 or 13 further comprising the step of calibrating said metal film by rolling.

* * * * *